US005197974A

United States Patent [19]

Scarpelli et al.

[11] Patent Number: 5,197,974

[45] Date of Patent: Mar. 30, 1993

[54] PACIFIER APPARATUS WITH HEATING OR COOLING CAPABILITIES

[76] Inventors: Elizabeth J. Scarpelli; Christian M. Scarpelli, both of 2155 Federal Rd., Roswell, Ga. 30075

[21] Appl. No.: 801,409

[22] Filed: Dec. 2, 1991

[51] Int. Cl.[5] ..... A61J 17/00

[52] U.S. Cl. ..... 606/235; 606/234; 606/236

[58] Field of Search ..... 606/234, 235, 236; 215/11.1-11.6

[56] References Cited

U.S. PATENT DOCUMENTS

| | | | |
|---|---|---|---|
| 1,235,169 | 7/1917 | Tallon | 606/236 |
| 3,289,986 | 12/1966 | Martin | 606/234 |
| 3,669,117 | 6/1972 | Herbst | 606/235 |
| 3,875,940 | 4/1975 | Beuther | 606/234 |
| 4,447,164 | 5/1984 | Berndt | 606/234 |
| 5,013,321 | 5/1991 | MacVane | 606/234 |

FOREIGN PATENT DOCUMENTS

| | | | |
|---|---|---|---|
| 0875259 | 7/1949 | Fed. Rep. of Germany | 606/234 |
| 0555901 | 11/1958 | Italy | 606/234 |
| 0254945 | 1/1949 | Switzerland | 606/234 |
| 0007964 | of 1898 | United Kingdom | 606/235 |

*Primary Examiner*—Stephen C. Pellegrino
*Assistant Examiner*—Glenn Dawson
*Attorney, Agent, or Firm*—Leon Gilden

[57] ABSTRACT

A nipple member of flexible construction includes a fluid contained therewithin permitting chilling or heating of the nipple member to accommodate various additional applications for use with an infant. The nipple structure is arranged and mounted to an underlying support plant that in turn may be alternatively be secured to securement tethers or to an underlying rattle container for the amusement and entertainment of an infant.

3 Claims, 6 Drawing Sheets

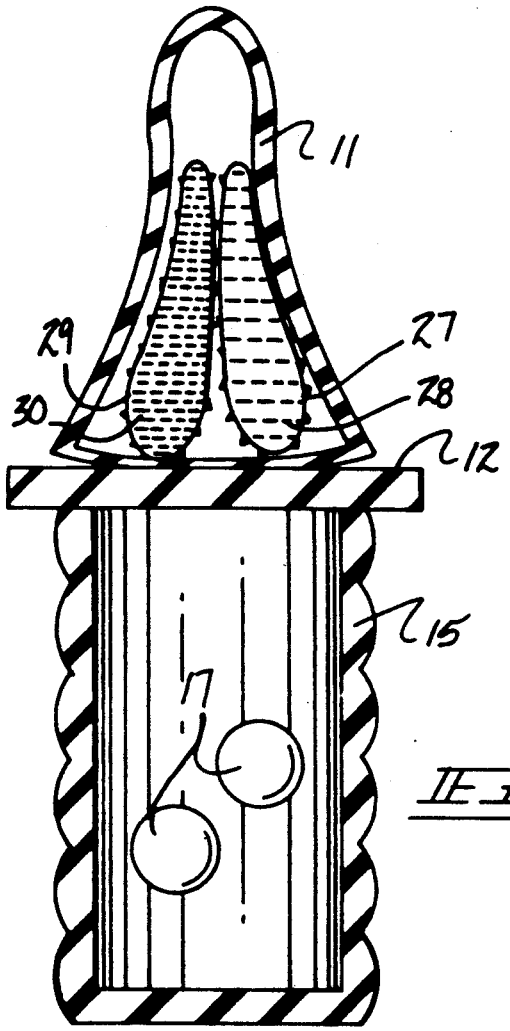
Fig 12
Fig 12a
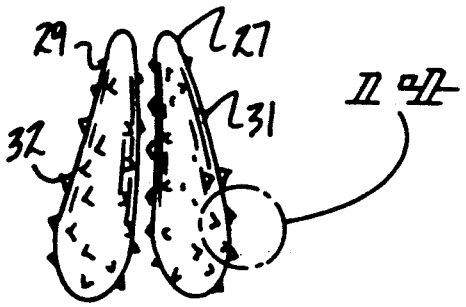
Fig 13
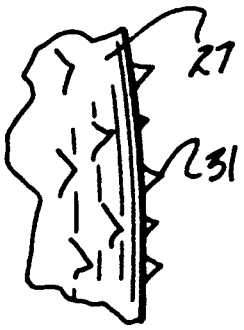

PACIFIER APPARATUS WITH HEATING OR COOLING CAPABILITIES

BACKGROUND OF THE INVENTION

1. Field of the Invention

The field of invention relates to pacifier apparatus, and more particularly pertains to a new and improved pacifier apparatus wherein the same is arranged for the medicinal and soothing application relative to an infant.

2. Description of the Prior Art

Pacifier apparatus of various types are utilized throughout the prior art. Frequently through an infant's growth, an infants mouth is sore due to various ailments and the normal teething cycle.

Prior art apparatus is exemplified in U.S. Pat. No. 4,116,202 to Panicci wherein a teething ring is arranged for permitting fluid under pressure to be intercommunicated relative to separate cells in the ring structure.

U.S. Pat. No. 3,825,014 to Wroten sets forth a pacifier utilizing a lip guard and a web contained with an underlying ring within the organization. Interior surface of the nipple is formed with ribs mounted to an interior wall thereof.

U.S. Pat. No. 4,192,307 to Baer sets forth a pacifier with a sweet fluid directed therefrom during a teething procedure.

As such, it may be appreciated that there continues to be a need for a new and improved pacifier apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pacifier apparatus now present in the prior art, the present invention provides a pacifier apparatus wherein the same includes at least one fluid component contained therewithin to permit heating or cooling thereof for use in a pacifier procedure relative to an infant. As such, the general purpose of the present invention, which will be described subsequently in greater detail, is to provide a new and improved pacifier apparatus which has all the advantages of the prior art pacifier apparatus and none of the disadvantages.

To attain this, the present invention provides a nipple member of flexible construction including a fluid contained therewithin permitting chilling or heating of the fluid to accommodate various additional applications for use with an infant. The nipple structure is arranged and mounted to an underlying support plate that in turn may be alternatively be secured to securement tethers or to an underlying rattle container for the amusement and entertainment of an infant.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pacifier apparatus which has all the advantages of the prior art pacifier apparatus and none of the disadvantages.

It is another object of the present invention to provide a new and improved pacifier apparatus which may be easily and efficiently manufactured and marketed.

It is a further object of the present invention to provide a new and improved pacifier apparatus which is of a durable and reliable construction.

An even further object of the present invention is to provide a new and improved pacifier apparatus which is susceptible of a low cost of manufacture with regard to both materials and labor, and which accordingly is then susceptible of low prices of sale to the consuming public, thereby making such pacifier apparatus economically available to the buying public.

Still yet another object of the present invention is to provide a new and improved pacifier apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration of a further aspect of the invention utilizing a support clamp for securement to adjacent furniture and the like.

FIG. 10 is an orthographic view, taken along the lines 10—10 of FIG. 9 in the direction indicated by the arrows.

FIG. 12 is an isometric illustration of a further modified aspect of the invention.

FIG. 13 is an orthographic view of the fluid supporting pouches of the invention.

FIG. 14 is an enlarged orthographic view of section 14 as set forth in FIG. 13.

DESCRIPTION OF THE PREFERRED EMBODIMENT

Figure 1:
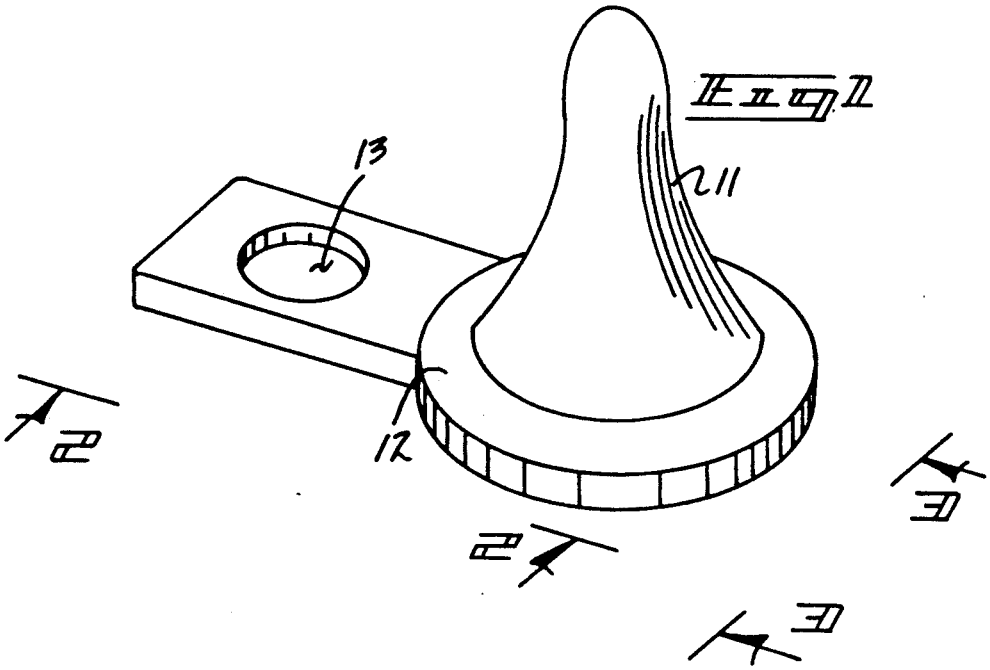
FIG. 1 is an isometric illustration of the instant invention.

With reference now to the drawings, and in particular to FIGS. 1 to 16 thereof, a new and improved pacifier apparatus embodying the principles and concepts of the present invention and generally designated by the reference numerals 11-36 will be described.

Figure 2:
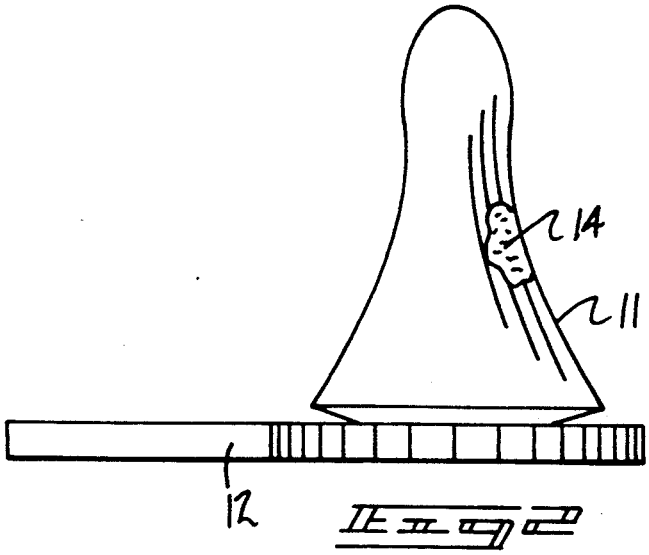
FIG. 2 is an orthographic side view of the instant invention as set forth in FIG. 1, taken along the lines 2—2 in the direction indicated by the arrows.
Figure 3:
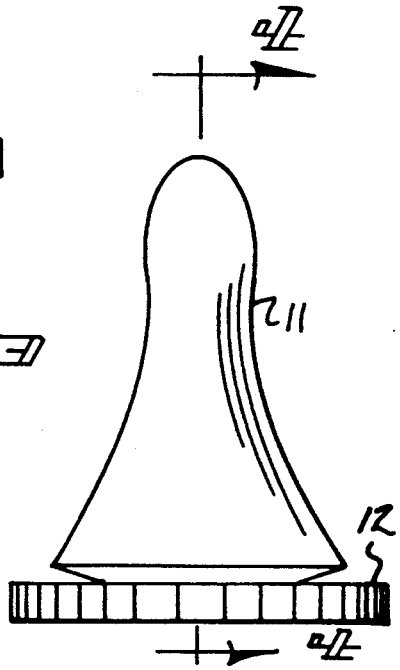
FIG. 3 is an orthographic view, taken along the lines 3—3 of FIG. 1 in the direction indicated by the arrows.
Figure 4:
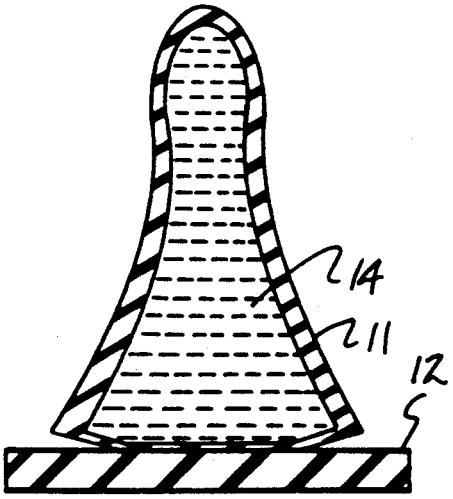
FIG. 4 is an orthographic view, taken along the lines 4—4 of FIG. 3 in the direction indicated by the arrows.

More specifically, the pacifier apparatus of the instant invention essentially comprises a resilient nipple 11 whose configuration includes a base portion tapering upwardly relative to the base, with a rigid support plate 12 mounted fixedly to the base, with the support plate 12 extending laterally thereof, as illustrated in the FIGS. 1-3, including an aperture 13 therethrough for securement of the support plate relative to various tether lines and the like, as well as for the insertion of an infant's finger therethrough for positioning the nipple 11 as required. The nipple 11 includes a fluid 14 contained therewithin to permit selective heating or cooling of the fluid for use in a pacifier procedure for the soothing of an infant oral region in use.

Figure 5:
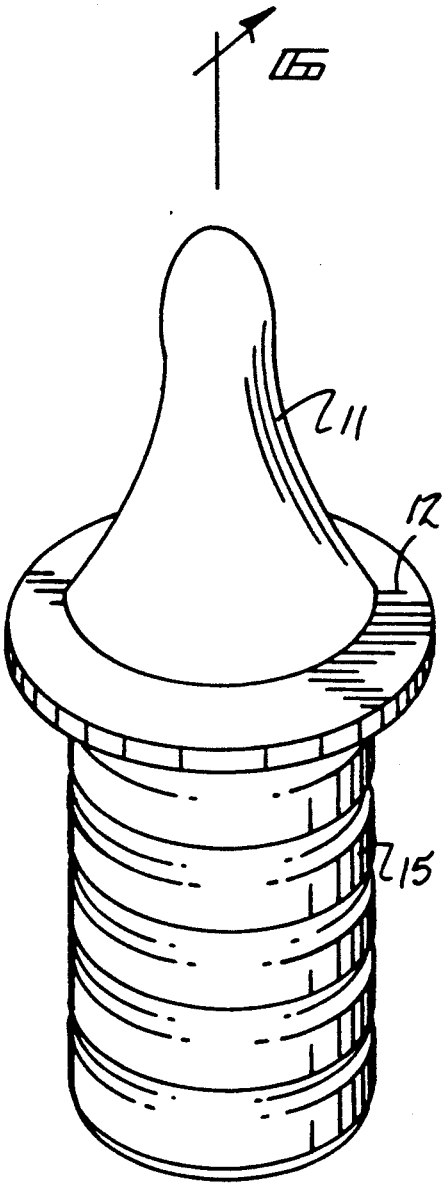
FIG. 5 is an isometric illustration of the invention utilizing an underlying container.
Figure 6:
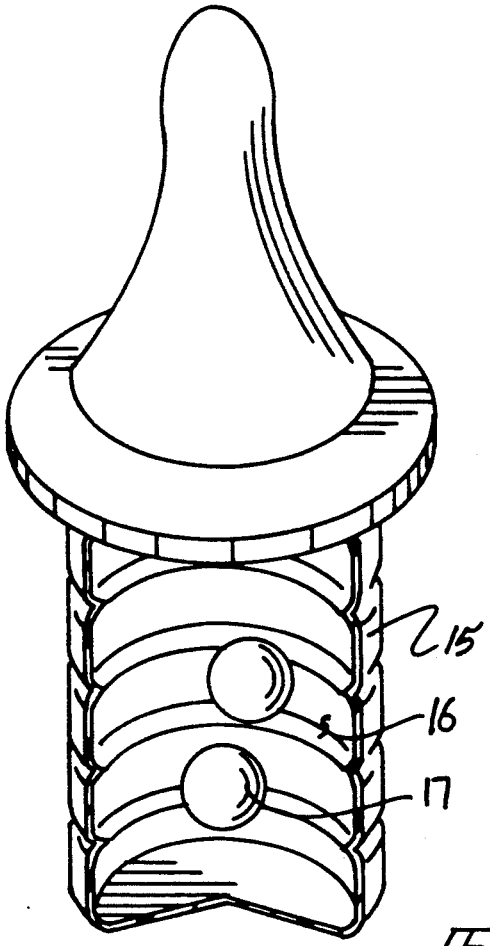
FIG. 6 is an isometric illustration, taken along the lines 6—6 of FIG. 5 in the direction indicated by the arrows.

The FIGS. 5 and 6 illustrate the use of a housing 15 extending downwardly from the support plate 12, including an enclosure that contains a plurality of rattle spheres 17 therewithin to enhance amusement of the organization in use.

Figure 7:
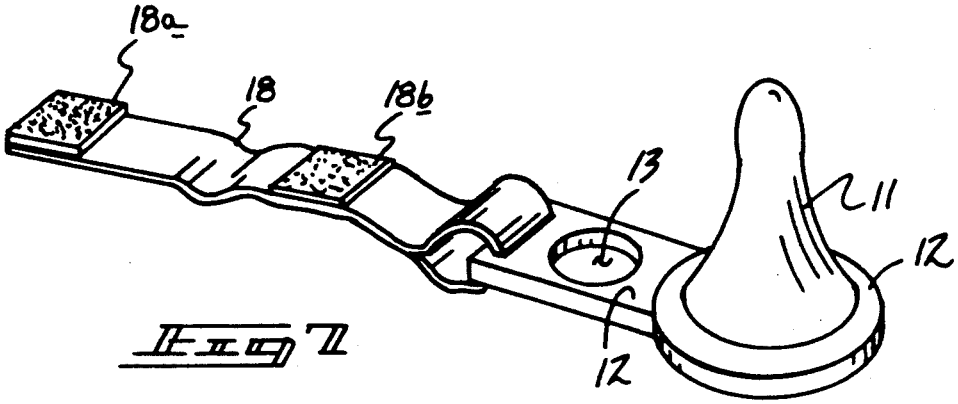
FIG. 7 is an isometric illustration of the invention utilizing a securement tether strap.

The FIG. 7 illustrates the use of a flexible strap 18 mounted through the support plate 12 at a remote distal end thereof, spaced from the nipple 11, with the flexible strap 18 including a first and second respective hook and loop fastener patch 18*a* and 18*b* cooperative relative to one another to permit ease of mounting the organization to a support belt and the like.

Figure 8:
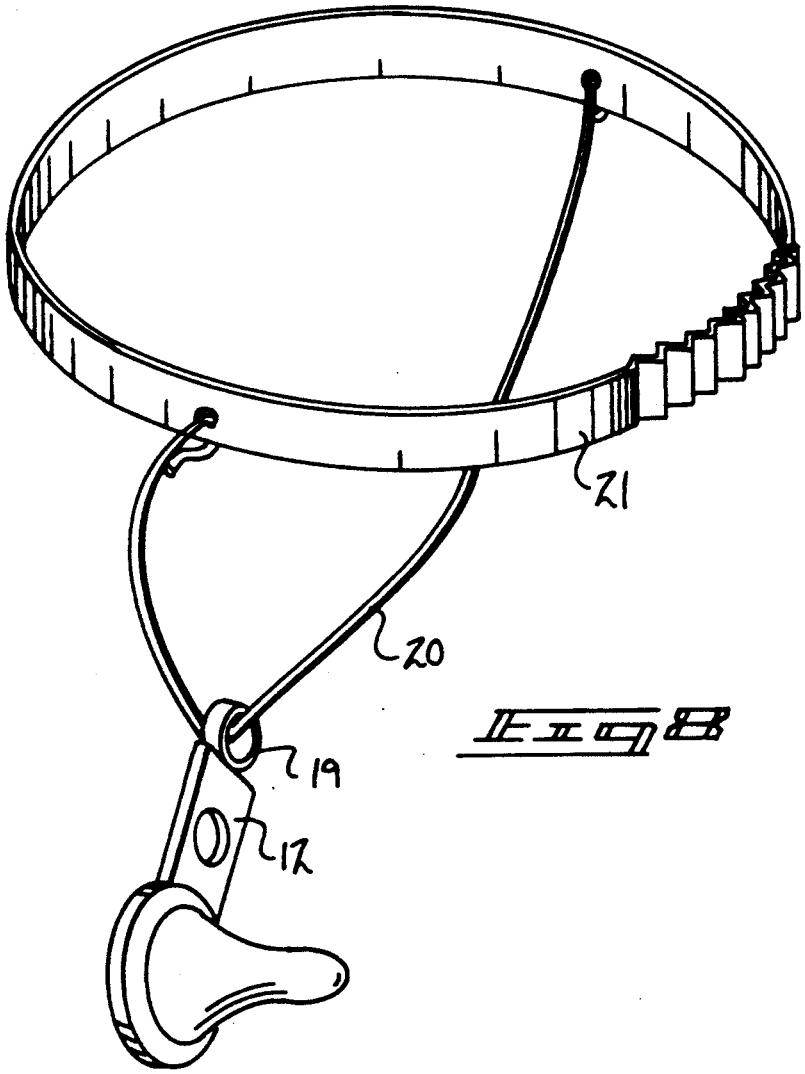
FIG. 8 is an isometric illustration of the invention mounted to an associated elastomeric torso band.

FIG. 8 illustrates the support plate 12 utilizing a support loop 19 mounted thereto, with a flexible tether line 20 directed through the loop 19, with the tether line's opposed distal ends diametrically mounted on an opposed relationship relative to an associated elastomeric torso band 21 for ease of securement of the organization relative to the torso portion of an infant.

Figure 11:
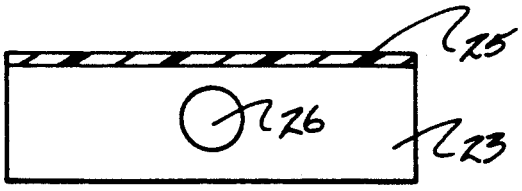
FIG. 11 is an orthographic view, taken along the lines 11—11 of FIG. 10 in the direction indicated by the arrows.
Figure 11:
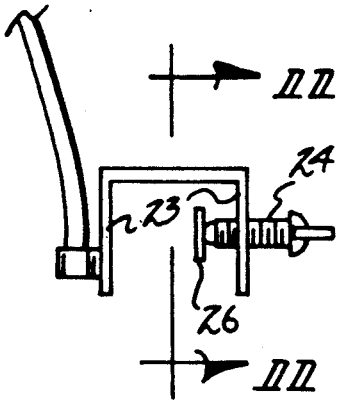
Figure 9:
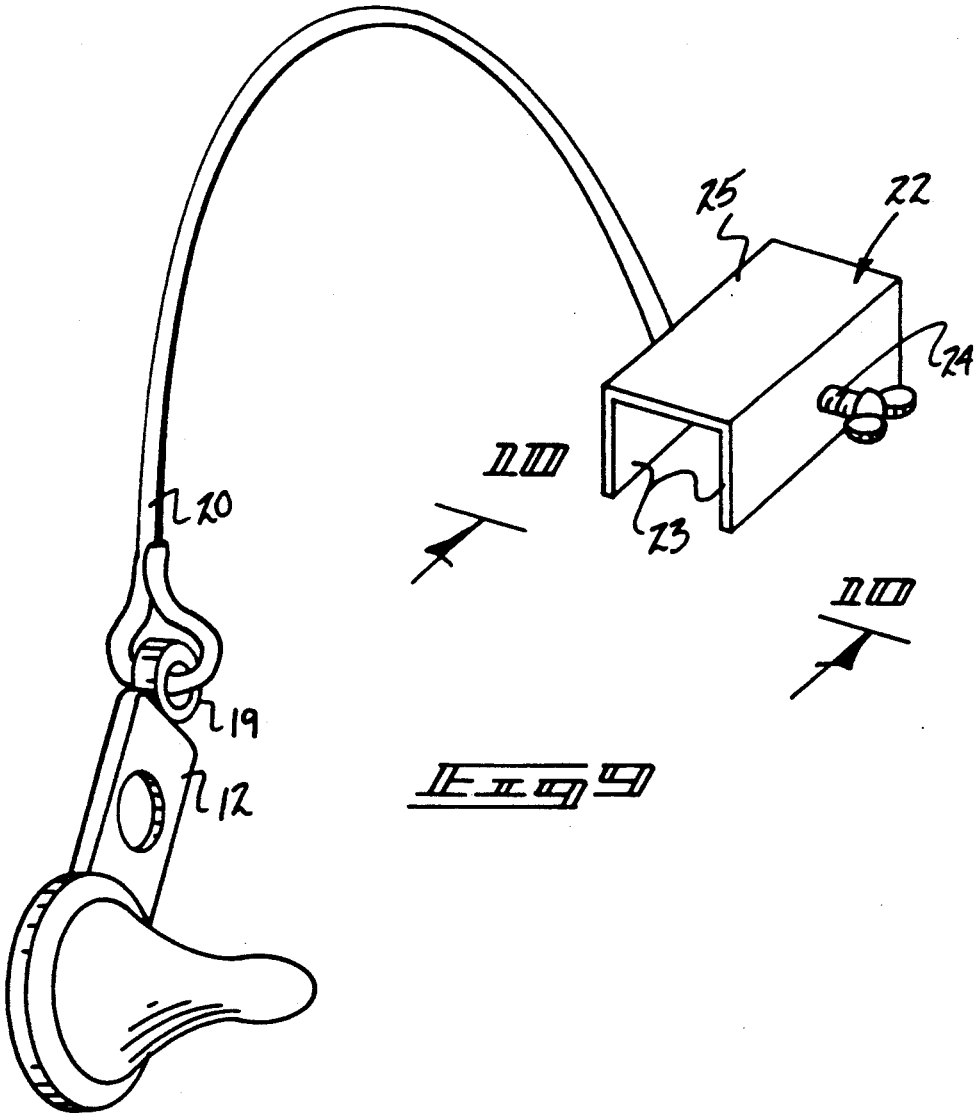

The FIGS. 9-11 illustrate the tether line 20, including a first distal end mounted through the loop 19 and a second distal end secured to an associated "U" shaped seat clamp 22 for securement of the seat clamp to a flange portion of a furniture such as a seat, a crib, and the like providing for proper orientation of the pacifier structure relative to an infant. The seat clamp 22 includes spaced parallel flanges 23, with a threaded clamping rod 24 orthogonally directed through one of the flanges 23 below a clamp top web 25. The clamping rod 24 includes a presser foot 26 mounted to the clamping rod 24 between the spaced parallel flanges 23.

The FIGS. 12-14 illustrate the support plate 12 mounted to the container 15, in a manner as described relative to the FIGS. 5 and 6. Further, a respective first and second fluid pouch 27 and 29 are contained within the flexible and resilient nipple 11 containing a respective first and second fluid 28 and 30. The fluids depending upon their compositions when inter-mixed upon rupturing of the first and second pouches 27 and 29 create either an exothermic or endothermic reaction to provide for soothing of an infant's oral region. The first and second pouches to enhance ease of rupturing of the pouches and inter-mixing of the fluids, contain respective first and second projections 31 and 32 arranged about the exterior surface of the respective first and second pouches 27 and 29. Each projection is of a predetermined length less than the predetermined thickness of the resilient nipple wall.

Figure 15:
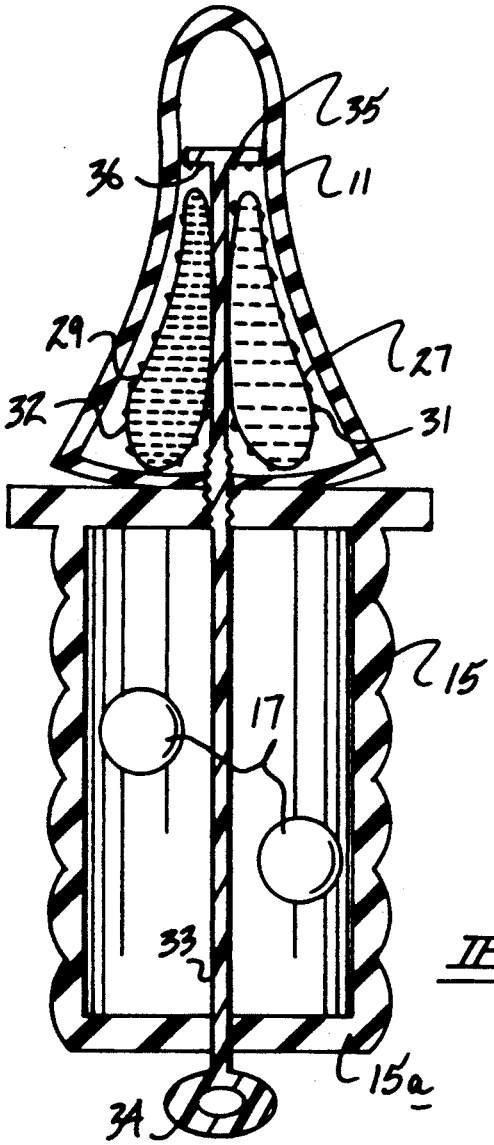
FIG. 15 is a further modification of the invention as set forth in FIG. 12.
Figure 16:
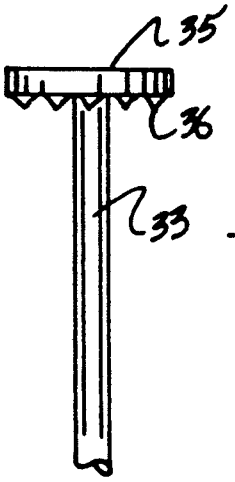
FIG. 16 is an enlarged orthographic view of the head plate member as set forth in FIG. 15.

The FIGS. 15 and 16 illustrate the additional use of a rupture rod 33 reciprocatably mounted coaxially through the housing 15 projecting through a housing floor 15*a*, with a handle 34 mounted to a lower distal end of the rod 33 exteriorly of the floor 15*a*. An upper distal end of the rod 33 includes a head plate 35 mounted thereto, with the head plate including a matrix of head plate spikes 36 fixedly mounted thereto in overlying relationship relative to the first and second pouches 27 and 29 to enhance ease of rupturing and admixing of the fluids 28 and 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pacifier apparatus, comprising, a resilient nipple, the resilient nipple including an enclosed cavity therewithin, wherein the nipple includes a base, and the base is fixedly mounted to a support plate, and the support plate includes a housing mounted to the support plate, and wherein the nipple is mounted to a top surface of the support plate and the housing is mounted to a bottom surface of the support plate, wherein the housing and the nipple are coaxially aligned, and the housing includes a housing cavity, the housing cavity includes a plurality of spheres contained therewithin, and a first flexible fluid pouch contained within the nipple cavity containing a first fluid, and a second fluid pouch contained within the nipple cavity containing a second fluid, the first fluid pouch and the second fluid pouch positioned in contiguous relationship relative to one another, said first fluid when mixed with said second fluid producing either an exothermic or endothermic reaction, depending on the composition of the fluids, soothing an infants teething gums.

2. An apparatus as set forth in claim 1 wherein the first fluid pouch includes a first exterior surface and the second fluid pouch includes a second exterior surface, and the first exterior surface includes a first matrix of projections mounted to the first exterior surface, and a second matrix of projections are mounted to the second exterior surface, wherein each projection of said first and second matrixes of projections are defined by a predetermined length, and the nipple includes a nipple wall defined by a predetermined thickness, wherein the predetermined length is less than the predetermined thickness thus allowing the piercing of the two fluid pouches when compressed by the action of a teething infant causing the mixing of the two fluids in order to produce said exothermic or endothermic reaction.

3. An apparatus as set forth in claim 2 including a rupture rod slidably and coaxially directed through the housing, with an upper terminal end of the rupture rod contained within the nipple cavity, and the upper terminal end of the rupture rod including a head plate orthogonally mounted to the upper terminal end of the rupture rod, and the head plate including a matrix of head plate spikes mounted to a bottom surface of the head plate positioned above the first fluid pouch and the second fluid pouch, with the rupture rod projected medially and between the first fluid pouch and the second fluid pouch, and a lower distal end of the rupture rod extending exteriorly of the housing, wherein the housing includes a housing floor and the rupture rod lower distal end is positioned exteriorly of the housing floor, and a handle mounted to the lower distal end of the rupture rod, said rupture rod assisting in the piercing of the fluid pouches by compressing said head plate spikes against said fluid pouches.

* * * * *